US009598808B2

(12) United States Patent
Guzman

(10) Patent No.: US 9,598,808 B2
(45) Date of Patent: Mar. 21, 2017

(54) LAUNDRY TREATING APPLIANCE WITH METHOD TO DETECT THE TYPE AND SIZE OF A LOAD

(75) Inventor: Sylvia A. Guzman, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 1436 days.

(21) Appl. No.: 13/271,478

(22) Filed: Oct. 12, 2011

(65) Prior Publication Data

US 2013/0091635 A1 Apr. 18, 2013

(51) Int. Cl.

| | |
|---|---|
| ***D06L 1/00*** | (2006.01) |
| ***D06F 21/00*** | (2006.01) |
| ***D06F 33/00*** | (2006.01) |
| ***D06F 33/02*** | (2006.01) |
| ***D06F 35/00*** | (2006.01) |

(52) U.S. Cl.

CPC ..... *D06F 33/02* (2013.01); *D06F 35/005* (2013.01); *D06F 2202/085* (2013.01); *D06F 2202/10* (2013.01); *D06F 2204/088* (2013.01)

(58) Field of Classification Search

CPC .. D06F 35/005; D06F 33/02; D06F 2202/085; D06F 2204/088; D06F 2202/10

See application file for complete search history.

(56) References Cited

U.S. PATENT DOCUMENTS

| | | | | |
|---|---|---|---|---|
| 4,303,406 | A * | 12/1981 | Ross | 8/158 |
| 5,144,819 | A | 9/1992 | Hiyama et al. | |
| 5,259,217 | A | 11/1993 | Civanelli et al. | |
| 5,337,431 | A | 8/1994 | Kim et al. | |
| 5,768,728 | A * | 6/1998 | Harwood et al. | 8/158 |
| 5,768,729 | A * | 6/1998 | Cracraft | 8/158 |
| 5,897,672 | A | 4/1999 | Badami et al. | |
| 6,634,191 | B1 | 10/2003 | Guler et al. | |
| 2007/0143933 | A1 * | 6/2007 | Potyrailo et al. | 8/158 |
| 2008/0078035 | A1 * | 4/2008 | Haught | 8/137 |
| 2008/0120790 | A1 * | 5/2008 | Ashrafzadeh et al. | 8/159 |
| 2008/0172804 | A1 * | 7/2008 | Vanhazebrouck et al. | 8/158 |
| 2010/0024490 | A1 | 2/2010 | Nieh et al. | |

FOREIGN PATENT DOCUMENTS

| | | | |
|---|---|---|---|
| DE | 3002786 | A1 | 8/1981 |
| DE | 3030491 | A1 | 2/1982 |
| DE | 4304031 | A1 | 8/1994 |
| EP | 0787848 | B1 | 8/1997 |
| GB | 2262363 | A | 6/1993 |
| JP | 5277282 | A | 10/1993 |
| JP | 5329289 | A | 12/1993 |

OTHER PUBLICATIONS

German Search Report for counterpart DE102012107354, Jun. 27, 2013.

* cited by examiner

*Primary Examiner* — Michael Barr
*Assistant Examiner* — Benjamin L Osterhout

(57) ABSTRACT

A method and a laundry treating appliance for detecting the type and size of a load prior to a cycle of operation.

13 Claims, 4 Drawing Sheets

LAUNDRY TREATING APPLIANCE WITH METHOD TO DETECT THE TYPE AND SIZE OF A LOAD

BACKGROUND OF THE INVENTION

Laundry treating appliances, such as a washing machine, may have a rotatable drum in which laundry may be placed for treatment. For some laundry treating appliances, the laundry may be provided with liquid to treat the laundry in accordance with a cycle of operation. The laundry may absorb a portion of the liquid. The amount of liquid absorbed by the laundry may differ by the composition of the laundry. For example, the laundry having cotton tends to absorb a high amount of liquid, while the laundry having polyester tends to absorb a small amount of liquid.

The physical orientation of the laundry may also lead to liquid being retained in the laundry. For example, if the laundry forms a pocket, liquid may at least temporarily pool in the pocket and more slowly pass through the laundry. The pooling of liquid may be exacerbated by the lower degree of absorbency or the greater degree of impermeability of the laundry.

SUMMARY OF THE INVENTION

The invention relates to a method of operating a laundry treating appliance having a liquid chamber and a treating chamber by supplying liquid into the treating chamber to a first level within the liquid chamber, determining a first time indicative of the time for the liquid to reach the first level, determining whether the laundry load is at least one of a small load and an absorbent load based on the first time, supplying liquid into the treating chamber to a second level within the liquid chamber at least reaching the treating chamber to define a second liquid supply, determining a second time indicative of the time for the liquid to reach the second level, and determining whether the laundry load is at least one of a medium load and a maximum load based on the second time.

DESCRIPTION OF EMBODIMENTS OF THE INVENTION

Figure 1:
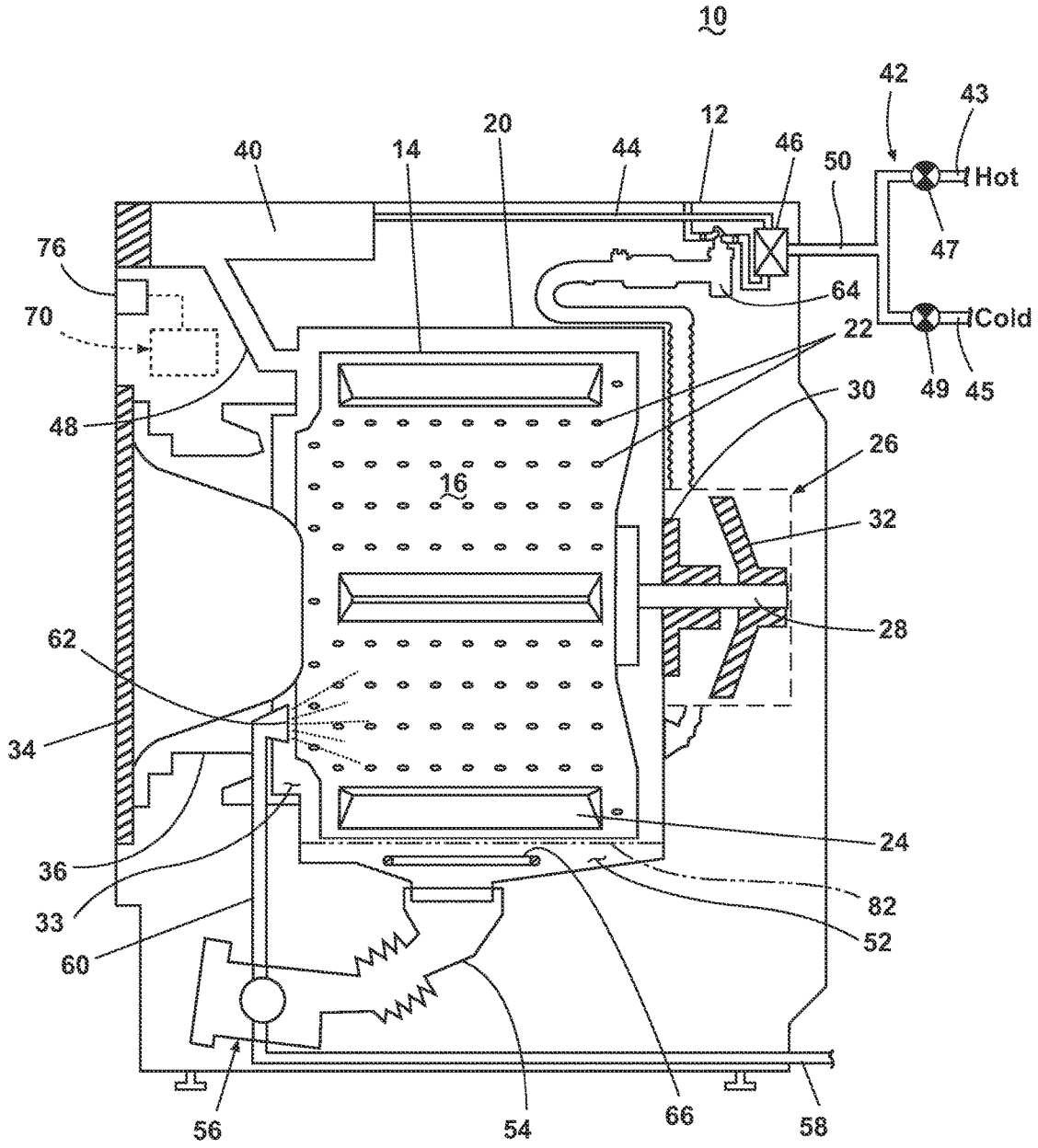
FIG. 1 is a schematic cross-sectional view of a laundry treating appliance according to one embodiment of the invention.

FIG. 1 illustrates a laundry treating appliance in the form of a horizontal washing machine 10 according to one embodiment of the invention. The laundry treating appliance may be any machine that treats articles such as clothing or fabrics. Non-limiting examples of the laundry treating appliance may include a top loading/vertical axis washing machine; a front loading/horizontal axis washing machine; a combination washing machine and dryer; and a refreshing/revitalizing machine. The washing machine 10 described herein shares many features of a traditional automatic washing machine, which will not be described in detail except as necessary for a complete understanding of the invention.

Washing machines are typically categorized as either a vertical axis washing machine or a horizontal axis washing machine. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through liquid in the drum. The liquid may include one of wash liquid and rinse liquid. The wash liquid may have at least one of water and a wash aid. Similarly, the rinse liquid may have at least one of water and a wash aid. The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis. As used herein, the "horizontal axis" washing machine refers to a washing machine having a rotatable drum, perforate or imperforate, that holds fabric items and washes the fabric items by the fabric items rubbing against one another as the drum rotates. In some horizontal axis washing machines, the drum rotates about a horizontal axis generally parallel to a surface that supports the washing machine. However, the rotational axis need not be horizontal. The drum may rotate about an axis inclined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles. The illustrated exemplary washing machine of FIG. 1 is a horizontal axis washing machine.

As illustrated in FIG. 1, the horizontal axis washing machine 10 may have a cabinet 12 that includes a rotatable drum 14 defining a treating chamber 16. A tub 20 may be positioned within the cabinet 12 and may define a liquid chamber 33 within which the rotatable drum 14 may be positioned for receiving laundry to be treated during a cycle of operation. The rotatable drum 14 may include a plurality of perforations 22, such that liquid may flow between the tub 20 and the drum 14 through the perforations 22. The drum 14 may further include a plurality of lifters 24 disposed on an inner surface of the drum 14 with predetermined gaps between the lifters 24 to lift the laundry load received in the treating chamber 16 while the drum 14 rotates.

While the illustrated washing machine 10 includes both the tub 20 and the drum 14, with the drum 14 defining the laundry treating chamber 16, it is within the scope of the invention for the washing machine 10 to include only one receptacle, with the receptacle defining the laundry treating chamber 16 for receiving the laundry load to be treated.

A motor 26 may be directly coupled with the drive shaft 28 to rotate the drum 14 at a predetermined speed and direction. The motor 26 may be a brushless permanent magnet (BPM) motor having a stator 30 and a rotor 32. Alternately, the motor 26 may be coupled to the drum 14 through a belt and a drive shaft to rotate the drum 14, as is known in the art. Other motors, such as an induction motor or a permanent split capacitor (PSC) motor, may also be used. The motor 26 may rotate the drum 14 at various speeds in either rotational direction.

Both the tub 20 and the drum 14 may be selectively closed by a door 34. A bellows 36 couples an open face of the tub 20 with the cabinet 12, and the door 34 seals against the bellows 36 when the door 34 closes the tub 20.

A detergent dispenser 40 may be provided to the washing machine 10 to dispense a treating chemistry during a cycle of operation. As illustrated, the detergent dispenser 40 may be located in the interior of the cabinet 12 such that the treating chemistry may be dispensed to the interior of the tub 20, although other locations are also possible. The detergent dispenser 40 may include a reservoir of treating chemistry that is releasably coupled to the detergent dispenser 40, which dispenses the treating chemistry from the reservoir to the treating chamber 16. The treating chemistry may be any type of chemistry for treating laundry, and non-limiting examples include, but are not limited to detergents, surfactants, enzymes, fabric softeners, sanitizers, de-wrinklers, and chemicals for imparting desired properties to the laundry, including stain resistance, fragrance (e.g., perfumes), insect repellency, and UV protection.

The washing machine 10 may further include a liquid supply and recirculation system. Liquid, such as water, may be supplied to the washing machine 10 from a water supply 42, such as a household water supply. The water supply may include a water supply configured to supply hot or cold water. The water supply may include a hot water inlet 43 and a cold water inlet 45, a valve assembly which may include a hot water valve 47, a cold water valve 49, and a conduit 50. The valves 47, 49 are selectively openable to provide water, such as from a household water supply to the conduit 50. The valves 47, 49 may be opened individually or together to provide a mix of hot and cold water at a selected temperature. While the valves 47, 49 and conduit 50 are illustrated exteriorly of the cabinet 12, it may be understood that these components may be internal to the cabinet 12. A supply conduit 44 may fluidly couple the water supply 42 to the tub 20 and the detergent dispenser 40. The supply conduit 44 may be provided with an inlet valve 46 for controlling the flow of liquid from the water supply 42 through the supply conduit 44 to either the tub 20 or the detergent dispenser 40.

A liquid conduit 48 may fluidly couple the detergent dispenser 40 with the tub 20. The liquid conduit 48 may couple with the tub 20 at any suitable location on the tub 20 and is shown as being coupled to a front wall of the tub 20 in FIG. 1 for exemplary purposes. The liquid that flows from the detergent dispenser 40 through the liquid conduit 48 to the tub 20 typically enters a space between the tub 20 and the drum 14 and may flow by gravity to a sump 52 formed in part by a lower portion of the tub 20. The sump 52 may also be formed by a sump conduit 54 that may fluidly couple the lower portion of the tub 20 to a pump 56. The pump 56 may direct fluid to a drain conduit 58, which may drain the liquid outside the washing machine 10, or to a recirculation conduit 60, which may terminate at a recirculation inlet 62. The recirculation inlet 62 may direct the liquid from the recirculation conduit 60 into the drum 14 or tub 20. The recirculation inlet 62 may introduce the liquid into the drum 14 or tub 20 in any suitable manner, such as by spraying, dripping, or providing a steady flow of the liquid.

The liquid supply and recirculation system may further include one or more devices for heating the liquid such as a steam generator 64 and/or a sump heater 66. The steam generator 64 may be provided to supply steam to the treating chamber 16, either directly into the drum 14 or indirectly through the tub 20 as illustrated. The inlet valve 46 may also be used to control the supply of water to the steam generator 64. The steam generator 64 is illustrated as a flow through steam generator, but may be other types, including a tank type steam generator. Alternatively, the heating element 66 may be used to heat laundry (not shown), air, the rotatable drum 14, or liquid in the tub 20 to generate steam, in place of or in addition to the steam generator 64. The steam generator 64 may be used to heat to the laundry as part of a cycle of operation, much in the same manner as heating element 66, as well as to introduce steam to treat the laundry.

Additionally, the liquid supply and recirculation system may differ from the configuration shown in FIG. 1, such as by inclusion of other valves, conduits, detergent dispensers, sensors, to control the flow of liquid through the washing machine 10 and for the introduction of more than one type of detergent/wash aid. Further, the liquid supply and recirculation system need not include the recirculation portion of the system or may include other types of recirculation systems.

Figure 2:
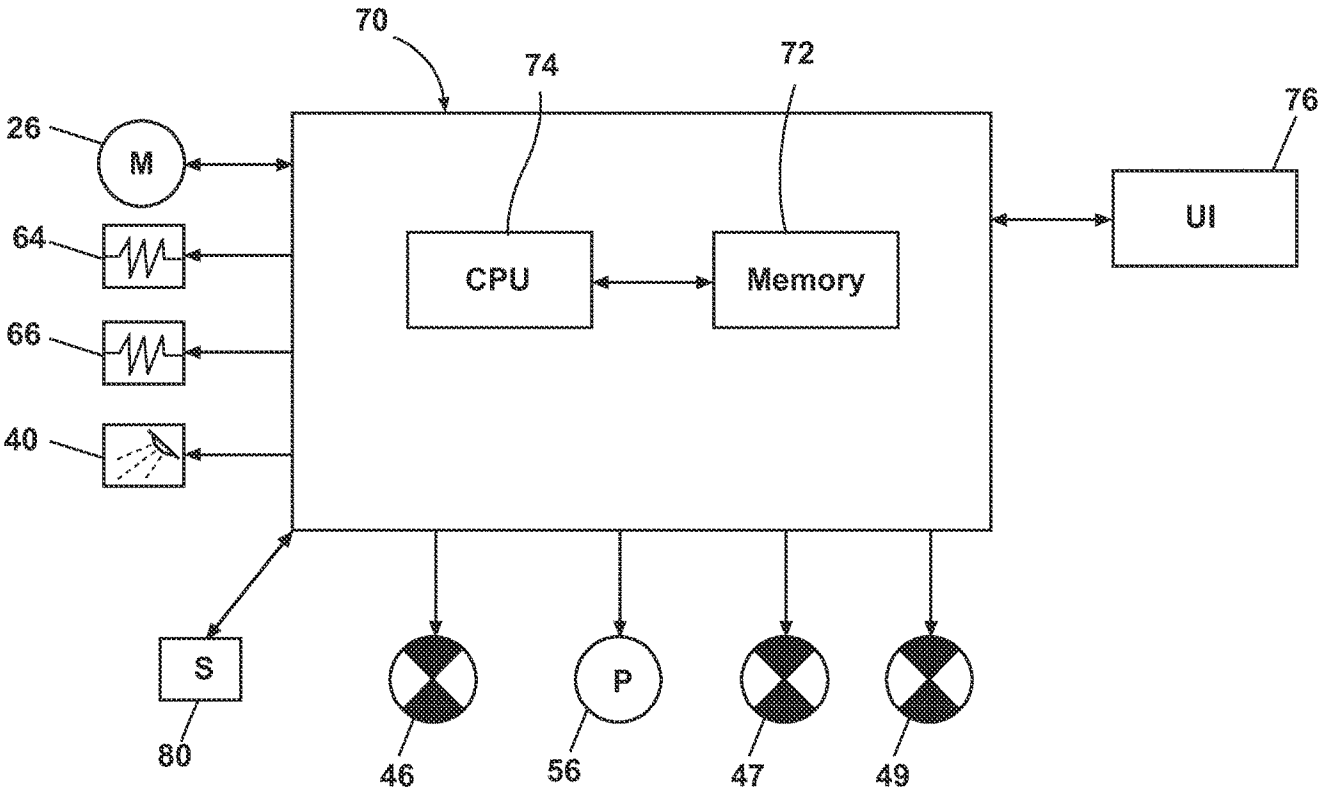
FIG. 2 is a schematic representation of a controller for controlling the operation of one or more components of the laundry treating appliance of FIG. 1.

The laundry treating appliance 10 may further include a controller 70 coupled with various working components of the laundry treating appliance 10 to control the operation of the working components. As illustrated in FIG. 2, the controller 70 may be provided with a memory 72 and a central processing unit (CPU) 74. The memory 72 may be used for storing the control software that may be executed by the CPU 74 in completing a cycle of operation using the laundry treating appliance 10 and any additional software. The memory 72 may also be used to store information, such as a database or table, and to store data received from the one or more components of the laundry treating appliance 10 that may be communicably coupled with the controller 70.

The controller 70 may be operably coupled with one or more components of the laundry treating appliance 10 for communicating with and/or controlling the operation of the components to complete a cycle of operation. For example, the controller 70 may be coupled with the hot water valve 47, the cold water valve 49, and the detergent dispenser 40 for controlling the temperature and flow rate of treating liquid into the treating chamber 16; the pump 56 for controlling the amount of treating liquid in the treating chamber 16 or sump 52; the motor 26 for controlling the direction and speed of rotation of the drum 30; and the user interface 76 for receiving user selected inputs and communicating information to the user.

The controller 70 may also receive input from one or more sensors 80, which are known in the art and not shown for simplicity. Non-limiting examples of additional sensors 80 that may be communicably coupled with the controller 70 include: a temperature sensor including a negative temperature coefficient (NTC) sensor or a positive temperature coefficient (PTC) sensor, a liquid level sensor which may be operably coupled to the tub 20 to detect the liquid level in the tub 20 and transmit the signal to the controller 70 such that the amount of liquid may be selectively controlled in the tub 20 during a cycle of operation, a weight sensor, a motor torque sensor, and a transducer such as a potentiometer.

The laundry treating appliance 10 may perform one or more manual or automatic treating cycle or cycles of operation. A common cycle of operation includes a wash phase, a rinse phase, and a spin extraction phase. Other phases for cycles of operation include, but are not limited to, intermediate extraction phases between the wash and rinse phases, and a pre-wash phase preceding the wash phase, and some cycles of operation include only a selected one or more of these exemplary phases.

A cycle of operation may be performed in the presence of liquid to effect the laundry in the interior of the treating chamber 16. During the cycle of operation, the laundry may absorb at least a portion of the liquid provided into the treating chamber 16. Generally, the absorbency of the laundry load tends to depend on the absorbency of fabric materials or the size of laundry load. For example, all other things being equal, the laundry having less absorbent fabric such as polyester may absorb small amount of liquid, while the laundry having highly absorbent fabric such as 100% cotton may absorb large amount of liquid. Similarly, all other things being equal, a larger load of the same type fabric will absorb more liquid than a small load of the same type of fabric. Thus, it is possible for a large load of relatively non-absorbent fabric to absorb about the same amount of liquid as a medium or small load of relatively absorbent fabric.

The amount of liquid absorbed by the load impacts the amount of liquid needed for a given cycle of operation. In the horizontal axis washing machine illustrated in FIG. 1, for example, the liquid provided is normally of a sufficient amount such that the drum 14 may rotate without exceeding a predetermined acceptable torque level and avoiding unnecessarily high contact/loading between the interior of the drum 14 and the laundry. The preferred liquid amount may be selected such that the laundry has a degree of buoyancy in the liquid in the interior of the treating chamber 16 to ensure the motor torque levels are within the design range of the motor 40 and the relative loading between the drum 14 and the laundry is acceptable. Too little liquid leads to unacceptable torque levels and high loading interaction with the laundry, and too much liquid is wasteful. The amount of liquid necessary is dependent on the absorbency of the laundry as the absorbed liquid, in an overly-simplified description, tends not to contribute to the buoyancy.

There are a variety of liquid fill methodologies for supplying the right amount of liquid for a given load, alone, or in combination with the selected cycle of operation. Some of the simplest systems just set the liquid level based on load size, without concern for the corresponding selected cycle of operation. The load size may be input by the user or automatically determined by the controller 70 as part of the cycle of operation. In the user input approach, the user may arbitrarily select one of the "Extra-Small", "Small", "Medium", "Large", and "Extra-Large" buttons on the user interface 76, to select the load size. However, user-imputted load sizes are more inconsistent and subject to greater error than automatically determined load sizes. Automatically determined load size determination can be accomplished by motor torque analysis or, in some cases, based on the liquid fill volumes.

The invention addresses the problems associated with determining the type and/or size of laundry load based on the absorption behavior of laundry load during a liquid filling phase of the cycle of operation by monitoring one or more filling times for the liquid to reach one or more predetermined levels during liquid filling steps.

Figure 3:
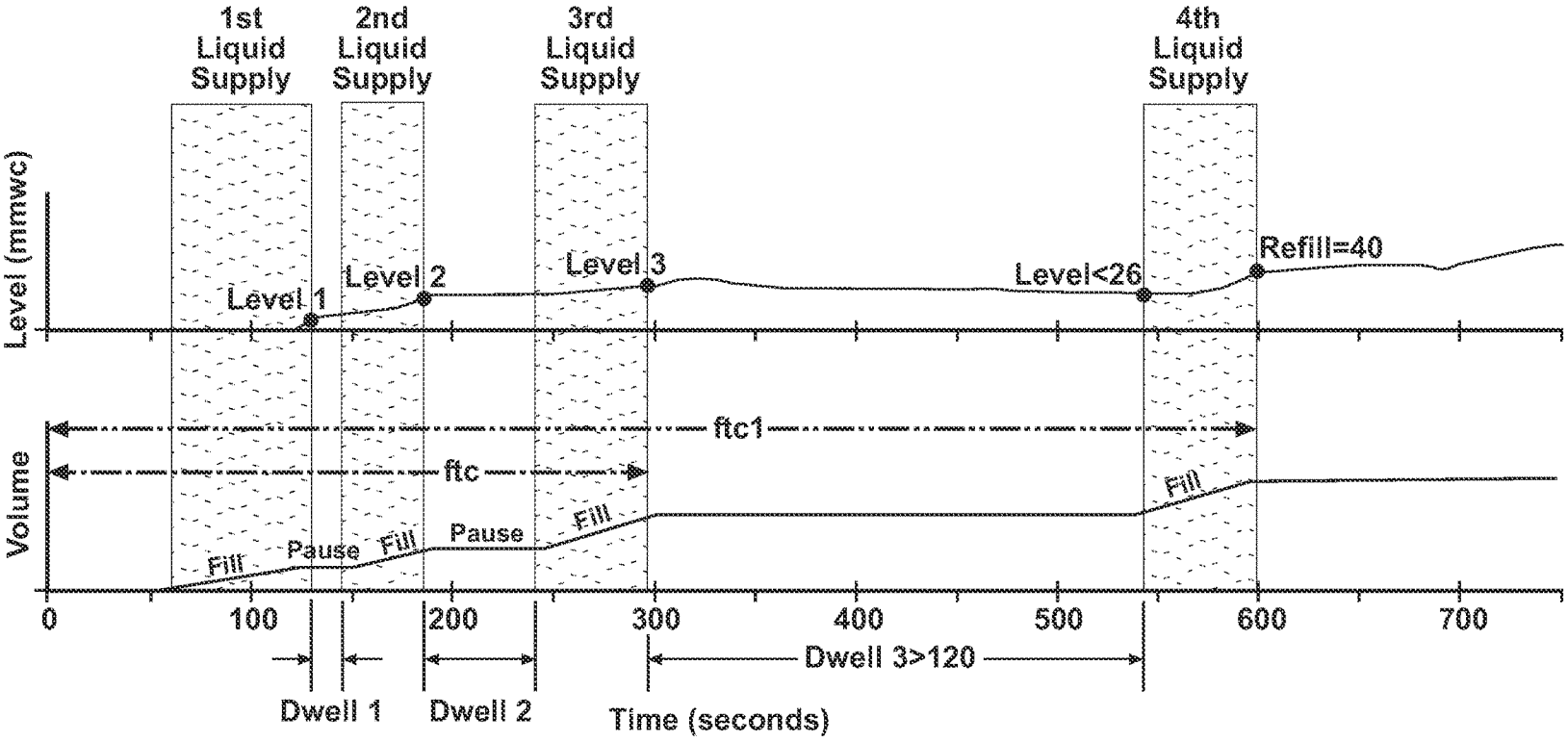
FIG. 3 is a schematic plot illustrating a liquid filling method forming one environment in which the invention may be applied.

While the particular liquid filling method is not limiting to the invention, FIG. 3 is a schematic plot illustrating one suitable liquid filling method during which the type and/or size of laundry in the laundry treating appliance 10 may be determined. It may be assumed that the laundry load is placed in the treating chamber 16 for treatment prior to a cycle of operation. It may be also assumed that the sequence of volume and pressure changes with time depicted in FIG. 3 is for illustrative purposes only, and is not meant to limit the method in any way as it is understood that the steps may proceed in a different logical order, additional or intervening steps may be included, or described steps may be divided into multiple steps, without detracting from the invention. The schematic plot may be incorporated into a cycle of operation for the laundry treating appliance 10, such as prior to or as part of any phase of a cycle of operation. The method may also be a stand-alone cycle.

As illustrated, the liquid pressure in terms of millimeters water column (mmwc), which corresponds to the liquid level in the liquid chamber 33, is illustrated with respect to the time. The change of liquid volume provided to the treating chamber 16, is also illustrated with respect to the time.

The method described in the schematic plot may begin by filling the liquid in the one of the treating chamber 16 and the liquid chamber 33 until the liquid level satisfies a first level which corresponds to Level 1, as measured by the liquid level sensor operably coupled to the liquid chamber 33. The liquid may be provided to the laundry in the treating chamber 16 by directly spraying the liquid on top of the laundry in the treating chamber 16. If necessary, hot water and cold water may be alternatively or simultaneously provided to the laundry to obtain the desired liquid temperature for the selected cycle of operation. All or part of the liquid may be supplied through the detergent dispenser 54 to aid the dispensing of the treating chemistry. Level 1 may be configured such that the liquid level is positioned below the bottom of the treating chamber 16 and above the bottom of the liquid chamber 33 to define a first liquid supply.

Once the liquid level reaches to the first level to satisfy Level 1, the liquid filling may be temporarily interrupted by the controller 70 until a first dwell time, Dwell 1, is satisfied. During the first dwell time, Dwell 1, some of the liquid may soak and pass through the laundry downwardly by gravity to the bottom of the liquid chamber 33. This liquid will increase the liquid level in the tub 20 from the Level 1. The liquid temperature may be also recorded by the temperature sensor.

After a passage of Dwell 1, an additional amount of liquid may be provided into the treating chamber 16 until the liquid level reaches to a second level that may corresponds to Level 2. For example, Level 2 may be configured to fill the liquid chamber 33 until the liquid level reaches to, at least, the bottom of the treating chamber 16 to define a second liquid supply. While the liquid is provided to the treating chamber 16, liquid temperature may be also measured by the temperature sensor to control the liquid temperature. When the liquid level satisfies the second level, the liquid filling may be interrupted until a second dwell time, Dwell 2, is satisfied. Similar to the first dwell time, Dwell 1, the liquid may soak and pass through the laundry downwardly by gravity to the bottom of the liquid chamber 33 during the second dwell time Dwell 2.

After a passage of the second dwell time, Dwell 2, liquid may be further provided to one of the treating chamber 16 and the liquid chamber 33 until the liquid level reaches to a third level corresponding to Level 3. The third level may be a liquid level which may be enough to operate a cycle of operation such as the wash phase or rinse phase to define a third liquid supply. Once the liquid level reaches to the third level, the laundry in the presence of the liquid in the treating chamber 16 may remain to be stationary in the treating chamber 16 for a predetermined time period of a third dwell time.

The third dwell time, Dwell 3, provides sufficient time for any liquid that will soak through the laundry to soak through. However, to avoid unnecessarily extending the total time for the filling process, Dwell 3 may be limited. For example, Dwell 3 is illustrated as being limited to a maximum of 120 seconds, which may be determined by monitoring the difference between ftc1 and ftc. It may be understood that ftc1 is the running time for the filling process, and is defined as a period of time during which a plurality of pressure targets may be reached and refills may be performed as necessary. ftc1 may be stored in the memory 72 of the controller 70. ftc1 diminishes with the progress of filling process and may be provided a varying time period until ftc1 reaches zero at the end of the filling process. For example, ftc1 may be initially defined as 600 seconds in the beginning of the filling algorithm, while ftc1 may be equal to 590 seconds after 10 seconds of the filling process. It may be noted that ftc1 may be initially set as 600 seconds while other time periods are possible. It is contemplated that, during ftc1 period, the laundry may be moved in the interior of the drum 30 according to a predetermined tumble process.

ftc is the total time at the beginning of Dwell 3, and may take the instant value of ftc1. For example, if Level 3 is reached after 150 seconds since the beginning of the filling process, the instant value of ftc1 may be 450 seconds, which may be also fixedly assigned to ftc. Dwell 3 may represent the time difference between the initial ftc1 and the instant value of ftc1. As illustrated, if this difference is greater than 120 seconds, then Dwell 3 is terminated. It may be noted that the third dwell time, Dwell 3, may vary laundry by laundry, depending on the cumulative time, ftc, which may in turn depend on the type and size of the laundry load.

During the third dwell time, Dwell 3, liquid is not further added to the treating chamber 16, and the liquid provided during the liquid supply may soak and pass through the laundry downwardly by gravity to the bottom of the liquid chamber 33. While the laundry may remain stationary in the treating chamber 16 during the third dwell time, Dwell 3, it is contemplated that the laundry is continuously agitated during the third dwell time by rotating the drum 14 according to a predetermined tumble process, until ftc1 is equal to zero. Agitating the laundry will release any trapped free liquid, such as liquid that is held in pockets formed by the laundry, which may then pass to the tub 20. As a result, until ftc1 reaches zero, the laundry may absorb liquid filled in the treating chamber 16, and the liquid level may not be immediately stabilized.

Depending on the liquid level change for the third dwell time, additional liquid may be further provided to one of the treating chamber 16 and the liquid chamber 33. For example, if Level 3 drops below 26 mmwc during the time period of more than 120 seconds, liquid may be additionally provided to increase the liquid level in the treating chamber 16 to a predetermined level, for example, 40 mmwc. In case Level 3 drops below 26 mmwc within the time period of less than 120 seconds, the liquid may be filled to another liquid level defined, which may be less than 40 mmwc.

While it may seem counter-intuitive that the liquid level may drop during the third dwell period, this can happen because there is the possibility that there may still be portions of the laundry that are dry and/or have not fully absorbed all of the liquid possible. As the laundry is agitated, these dry and/or not fully absorbed portions of laundry may be brought into contact with the liquid, which is now at a level that at least some of the laundry is partially immersed, which leads to liquid in the treating chamber that contributes to the liquid level being absorbed by the laundry and no longer contributing to the liquid level. Also, the agitation may lead to a higher piling of the laundry, which would effectively reduce the liquid level.

The type and size of laundry load may be determined based on the time required to reach each liquid level for each liquid supply step. That said, the time to reach each liquid level may be determined by at least one of the absorbency of fabric, load size and physical orientation of laundry in the treating chamber 16. For example, a laundry load having highly absorbent fabric, such as wash cloth having 100 percent cotton, tends to keep the liquid in the interior of the laundry load for a longer time before the liquid passes through the laundry downwardly to the bottom of the liquid chamber 33, compared to a laundry load having less absorbent fabric. Under this condition, it takes relatively longer time to increase the liquid level to each liquid level, and the plot of level with respect to the time may show a low or moderate magnitude of slope.

Regarding the load size effect, assuming all other things equal, there may be a possibility that a large laundry load may retain the liquid for longer time than a small load partly due to the formation of one or more liquid-retaining pockets in the laundry load. The pockets may be formed in the laundry load from the piling of the load and corresponding orientation of the load in the treating chamber 16. It may be understood that one or more pockets may work as separate pools to temporarily block the liquid from passing through the load to the liquid chamber 33, and requires an extended time to reach to each liquid level. In contrary, a small laundry load may not form enough pockets to block the flow of the liquid, and the liquid may flow directly to the tub 20.

If a large laundry load includes highly absorbent fabric, the pocket formation effect in the laundry load may be combined with the high absorbency of the laundry, which may further increase the time to reach each liquid level, and the plot of level with respect to the time may show a significantly low magnitude of slope. Under this condition, the liquid may not even fully wet the laundry while passing through the laundry load until the last liquid supply to the laundry load, which may result in a different filling behavior and may be suitable in clearly distinguishing the type and size of the laundry.

Therefore, the time to increase the liquid level to reach each liquid level may provide information about the liquid flow behavior through the load, and correspondingly the type and size of the load in the treating chamber 16. It may be understood that, in accordance with FIG. 3, the type and size of the laundry may be determined only after the method is complete. The fill times for different laundry loads may be stored as references to compare the measured times of the laundry load in the treating chamber 16 to the references to identify the type and size of the laundry.

Figure 4:
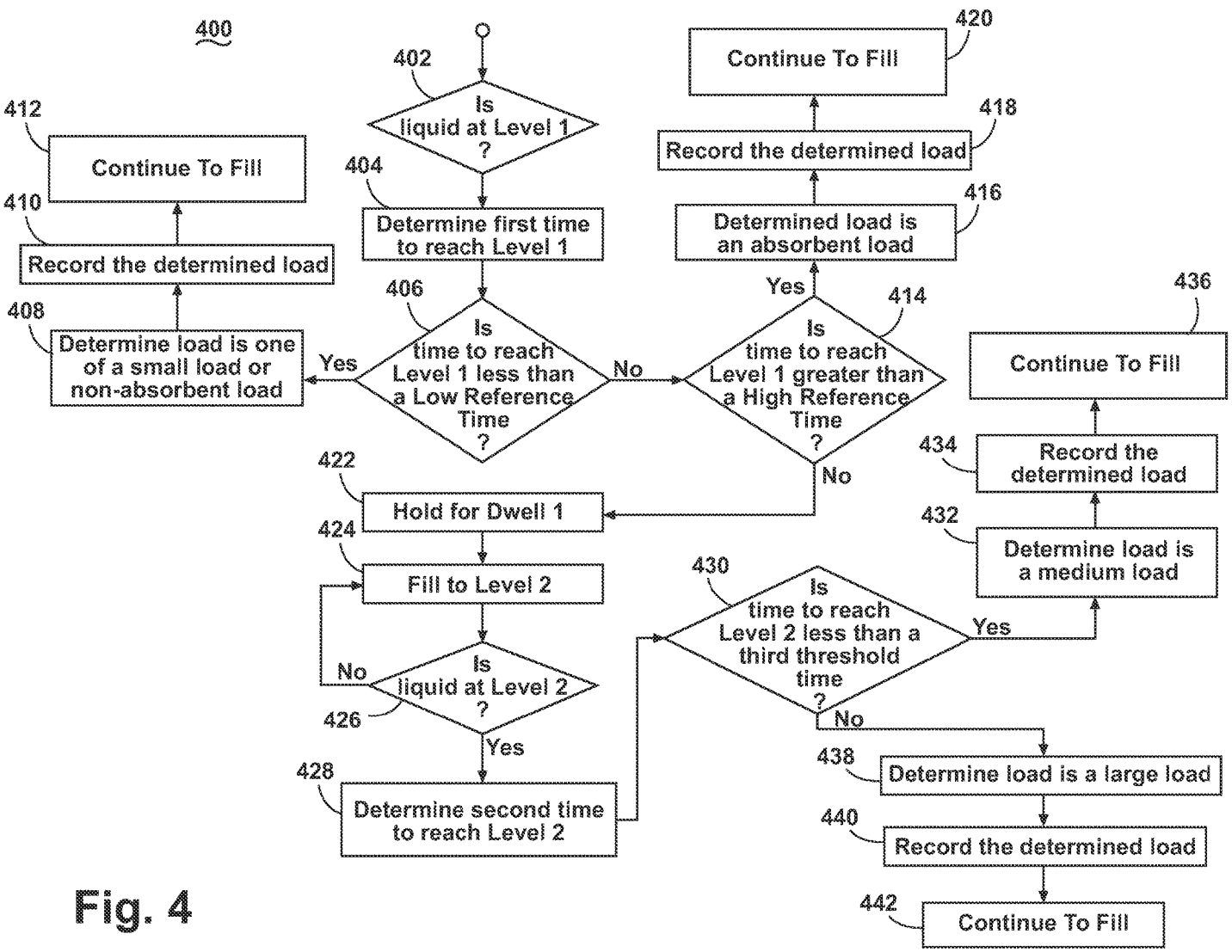
FIG. 4 is a flow chart illustrating how the type and size of laundry may be determined in the laundry treating appliance of FIG. 1 according to one embodiment of the invention.

FIG. 4 is a flow chart illustrating how the type and size of laundry may be determined during a filling operation in the laundry treating appliance of FIG. 1 according to one embodiment of the invention. The flow chart of FIG. 4 is for the filling operation of FIG. 3, but it should be understood that the filling method is not limiting.

It may be also understood that the sequence of steps depicted in FIG. 4 is for illustrative purposes only, and is not meant to limit the method in any way as it is understood that the steps may proceed in a different logical order, additional or intervening steps may be included, or described steps may be divided into multiple steps, without detracting from the invention. The method of FIG. 4 may be incorporated into a cycle of operation for the laundry treating appliance 10, such as prior to or as part of any phase of a cycle of operation. The method of FIG. 4 may also be a stand-alone cycle.

The method of FIG. 4 may begin at 402 by providing the liquid into the treating chamber 16 until the liquid level reaches a first level which corresponds to Level 1. The first level, Level 1, in the illustrated embodiment is typically a level above which the liquid level sensor can detect and below the bottom of the basket.

When the liquid level satisfies the Level 1, a first time to reach to Level 1 may be determined at 404. Then, at 406, the first time to reach the Level 1 may be compared to a Low Reference Time, where the Low Reference Time may be a first pre-determined threshold time to reach the Level 1. In one example, the Low Reference Time may be set as 51 seconds while other time periods are also possible.

The Low Reference Time may be the first threshold time indicative of the load being a small or non-absorbent load. The Low Reference Time may be practically described in conjunction with the Level 1 in the tub 20. In the case of absorbency, a non-absorbent load will absorb less liquid, resulting in more liquid quickly passing through to the tub 20, which results in the liquid level reaching Level 1 faster than it would if the load is absorbent. Thus, it is possible through testing to determine the Low Reference Time that will be indicative of a relatively non-absorbent load for a given machine.

The Low Reference Time may be also related to the laundry size. All other things being equal, if the load size is small, less liquid will be retained by the load as compared to larger loads, and more liquid will miss the laundry and pass directly to the tub 20 as compared to a larger load. Therefore, a shorter time to fill to Level 1 can be indicative of the small load size. Thus, testing may be used to determine the Low Reference Time that is indicative of a small load for a given machine. If the first time to reach the Level 1 is smaller than the Low Reference Time, at 408 and 410, it may be determined and recorded that at least one of the small load or non-absorbent load is located in the treating chamber 16. The small load or non-absorbent load may be selectively determined. For example, a load having approximately less than 5 pounds may be categorized as the small load. In another example, approximately less than 5 pounds of fabric having 50% of cotton and 50% of polyester may be determined to be the small load and the non-absorbent load. After the load is recorded, the load may be treated in accordance with a cycle of operation at 412. For example, the load may be provided with an additional liquid filling for subsequent washing step, where the amount of additional liquid filling may be suitable for the size and type of the laundry load determined at 408.

When the first time to reach Level 1 is equal to or greater than the Low Reference Time, process control passes to 414 where the first time is compared to a High Reference Time. The High Reference Time may be a second pre-determined threshold time greater than the Low Reference Time. If the first time is greater than the High Reference Time, the laundry load may be determined and recorded to be an absorbent load at 416 and 418. By the absorbent load, the laundry load may absorb approximately 15 liters of liquid to reach the Level 1. For example, the absorbent load may include a wash cloth having 100% cotton. Similar to 412, the load may be subsequently treated at 420.

As with the description of the Low Reference Time, the High Reference Time may be determined by testing to determine if the load is an absorbent load because, all other things being equal, the longer the time it takes for the liquid to reach Level 1 is indicative of the load being relatively more absorbent. Tests can be run for a given machine to determine a suitable value for the High Reference Time that is indicative of an absorbent load.

It is also possible to make conclusions about the size of the load based on the High Reference Time, such as whether the load is a large load. However, additional data is available during the rest of the filling process that provides for a more refined determination of the load size, which is why a load size determination is not made from the High Reference Time.

If the first time is equal to or smaller than the High Reference Time, the liquid filling may be paused for a first dwell time, Dwell 1, at 422. During the first dwell time, Dwell 1, liquid is permitted to pass through the laundry and into the tub 20 where the liquid will alter the liquid level reading. The first dwell time ensures that any free liquid has time to reach the tub 20. With the passage of Dwell 1, liquid filling into the treating chamber 16 may resume at 424 until the liquid level satisfies a second level, Level 2 at 426.

When the liquid level satisfies the second level, Level 2, a second time to reach Level 2 may be determined at 428. The second level, Level 2, in the illustrated embodiment is when the liquid reaches at least the bottom of the treating chamber 16. The second time is the time it takes for the liquid to fill from Level 1 to Level 2, which has been found to be indicative of making a determination between a large load size and a medium load size. All things being equal, it will take less time for the liquid level to increase from Level 1 to Level 2 for the medium load as compared to the large load. By measuring the time to fill from Level 1 to Level 2, it is possible to determine the second time that differentiates between the medium and the large load. One should note that the processes has already passed through the determination of the small load and the absorbent load, thus the second time needs only be concerned with differentiating between the medium and the large load.

Once the second time is determined at 428, the second time may be compared to a third threshold time at 430. In one example, the third threshold time may be set at 25 seconds while other threshold times may be also possible. When the second time is smaller than the third threshold time, the laundry load may be determined and then subsequently recorded to be a medium load at 432 and 434. The medium load may include approximately 6 to 13 pounds of load having 50% of cotton and 50% of polyester, or 100% of cotton that is not as absorbent as a wash cloth. Subsequently, similar to 412, the load may be treated at 436.

If the second time is equal to or greater than the third threshold time, the load may be determined and then recorded to be a large load at 438 and 440. The large load may include approximately greater than 15 pounds of load having 50% of cotton and 50% of polyester, or 100% of cotton that is not as absorbent as a wash cloth. Subsequently, similar to 412, the load may be treated at 442.

The invention described herein determines the time to reach one or more liquid levels in the liquid chamber in the presence of the laundry load to determine the type and size of the laundry load. The invention may be advantageous in that the type and size of the laundry load may be determined relatively within a short period of time, without waiting the whole liquid filling process. As a result, the overall treating cycle following the liquid filling process may be shortened.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a laundry treating appliance having a tub defining a liquid chamber, a drum rotatably mounted within the liquid chamber and defining a treating chamber for receiving a load of laundry for treatment, the method comprising:

supplying liquid into the treating chamber to a first level within the liquid chamber that is below the treating chamber to define a first liquid supply;

determining a first time indicative of the time for the liquid to reach the first level;

comparing the first time to a low reference threshold time or a high reference threshold time;

determining whether the laundry load is a small load when the first time is less than the low reference threshold time based on the comparing;

determining whether the laundry load is an absorbent load when the first time is greater than the high reference threshold time based on the comparing;

supplying liquid into the treating chamber to a second level within the liquid chamber at least reaching the treating chamber to define a second liquid supply;

determining a second time indicative of the time for the liquid to reach the second level;

comparing the second time to a third threshold time; and determining whether the laundry load is a medium load or a maximum load based on the comparing with the third threshold time.

2. The method of claim 1 wherein the third threshold time is a cumulative time including the first time.

3. The method of claim 1 wherein the determining whether the laundry load is at least one of a medium load and maximum load comprises determining whether the second time satisfies the third threshold time.

4. The method of claim 3 wherein when the second time is less than the third threshold time, the laundry load is determined to be a medium load, and when the second time is greater than the third threshold time, the laundry load is determined to be a maximum load.

5. The method of claim 1 further comprising a first dwell time, after the first liquid supply and prior to the second liquid supply, where no liquid is added to the treating chamber and the liquid from the first liquid supply is permitted to flow by gravity to the liquid chamber.

6. The method of claim 5 further comprising a second dwell time, after the second liquid supply, where no liquid is added to the treating chamber and the liquid from the second liquid supply is permitted to flow by gravity to the liquid chamber.

7. The method of claim 6 further comprising supplying liquid into either of the treating chamber or liquid chamber to a third level within the liquid chamber to define a third liquid supply.

8. The method of claim 7 wherein the third level is at least partially determined by at least one of the determined small load, medium load, maximum load, and absorbent load.

9. The method of claim 7 further comprising a third dwell time, after the third liquid supply, where no liquid is added to the treating chamber and the liquid from the third liquid supply is permitted to flow by gravity to the liquid chamber.

10. The method of claim 9 further comprising determining if the liquid in the liquid chamber is below the third level after the third dwell time, and supplying liquid to either of the treating chamber and liquid chamber to a level at least as high as the third level.

11. The method of claim 10 wherein the laundry load is agitated during at least one of the first, second, and third dwells, and at least during one of the first, second and third liquid supplies.

12. The method of claim 11 wherein the agitation of the laundry comprises rotating the drum.

13. The method of claim 1 wherein the small load is less than 5 lbs., the medium load is 6 to 13 lbs., the large load is greater than 15 lbs., and the absorbent load has an absorbency of water approximately greater than 15 liters to reach the first level.

* * * * *